United States Patent [19]

Moessinger

[11] 4,407,335

[45] Oct. 4, 1983

[54] PROCESS AND DEVICE FOR THE INSERTION OF A WEFT THREAD INTO THE SPACE BETWEEN TWO LINES OF WARP THREAD

[76] Inventor: Albert Moessinger, Chemin de l'Eglise Epalinges, 1066 Vaud, Switzerland

[21] Appl. No.: 228,952

[22] Filed: Jan. 27, 1981

[30] Foreign Application Priority Data

Jan. 30, 1980 [FR] France ..... 80 02316

[51] Int. Cl.[3] ..... D03D 47/36

[52] U.S. Cl. ..... 139/452

[58] Field of Search ..... 139/443, 452, 453, 116, 139/11; 226/113, 117, 118, 119

[56] References Cited

U.S. PATENT DOCUMENTS

| | | | |
|---|---|---|---|
| 3,130,755 | 4/1964 | Russell . | |
| 3,543,808 | 12/1970 | Moessinger . | |
| 3,580,444 | 5/1971 | Van Mulleken | 139/452 |
| 3,926,224 | 12/1975 | Vermeulen et al. | 139/452 X |

FOREIGN PATENT DOCUMENTS

| | | | |
|---|---|---|---|
| 1272843 | 7/1968 | Fed. Rep. of Germany . | |
| 2093302 | 1/1972 | France | 139/452 |
| 366473 | 12/1938 | Italy | 139/443 |
| 623865 | 6/1981 | Switzerland | 139/452 |
| 1204381 | 9/1970 | United Kingdom . | |

*Primary Examiner*—James Kee Chi

[57] ABSTRACT

The invention relates to a procedure and device for the insertion of a weft thread into the space between two lines of warp thread in a weaving loom without using any shuttle.

As per the invention, the thread to be inserted is fed to a pair of casting rollers forming between them a gripping line, with a guide being positioned above said rollers, and a gripping device being positioned so that the thread forms, between the above-mentioned elements, an acute angle with the gripping line of these rollers, and is positioned outside of this gripping line before being cast. For casting the thread, a system allows the thread to be moved between the rollers which shape the loop by themselves from a length of thread pulled out of a storage space.

11 Claims, 6 Drawing Figures

PROCESS AND DEVICE FOR THE INSERTION OF A WEFT THREAD INTO THE SPACE BETWEEN TWO LINES OF WARP THREAD

BACKGROUND OF THE INVENTION

This invention relates to an improvement of the weaving technique by which the weft thread is inserted into the shed formed by the warp threads without using any shuttle It relates in particular to an improvement of the technique known under the name of "inertia insertion," which is described in the French Pat. No. 1,562,147 (corresponding to the U.S. Pat. No. 3,543,808).

In a general manner, the aforesaid technique consists in casting the weft thread into the shed formed by the warp threads in the shape of a loop having at one end a free end, called the "cast strand" which is cast at high speed in a specific direction, that is to say, inside the space between the two layers of warp threads forming the shed. At the other end of the loop is a second end called the "locked strand" which is held by a clip outside the space between the two layers of warp threads. Thus, the kinetic energy within the cast strand changes, inside the loop, into a force pulling the thread in the direction of the loop motion, this force may be stronger than the air resistance.

The expression "cast strand" shall be used hereinafter in the description to designate the end of the loop which is freely cast, whereas the expression "locked strand" shall be used to designate the other part of this loop of thread.

The cast strand motion is produced either by means of a lever with a pin or a pulley at its free end, simultaneously accelerating the loop and the thread, or by being squeezed between rotating units consisting of two cylindrical or conical rollers with a peripheral velocity equal to the desired velocity for casting the thread. When utilizing rotating rollers for the casting operation, the thread is subjected to the acceleration, and not the loop as in the case of a lever, and the loop will shape by itself as a result of the tension of the strand held.

The invention relates in particular to an improvement of the procedure utilizing rotating rollers for casting the weft thread in the shape of a loop.

The main problem to solve in order to implement this procedure is the problem of the shaping of the loop. This is difficult to achieve and depends on the thread acceleration. As a matter of fact, when the startup is fast, the shaping of the loop is excellent due to the massive forces of the thread unwinding, however the startup tensions are excessive. If, on the other hand the startup is slow, the tensions are low, but the loop is fed by a thread going at an accelerated rate which comes into contact with the portions of the thread cast previously at a lower speed. It then shapes into a bale or ball, which increases the air resistance and makes the thread collapse.

Furthermore, it is difficult to regulate the sliding of the thread and apply an adequate acceleration, because of the variations of thicknesses and of the condition of the threads' surfaces.

To compensate for these disadvantages, several systems have been offered, for instance to accelerate the thread before the formation of a loop, and to recover the length of the thread unwound during the acceleration, for the thread which will be cast later on. Another suggestion has been made: to stretch the loop during its formation by means of a jet of compressed air. But all these procedures are complicated and costly.

In most of the known systems which utilize rotating rollers for casting the thread, both rollers are set apart for an instant in order to feed the thread to be cast, they are then brought together closely to hold the thread and pull it. This solution presents some difficulties. One of the two rollers at least must be able to complete a movement of translation perpendicular to its axis in order to be moved away from the other roller, so that the thread can be inserted. Furthermore, since the rollers must have the same outer speed to minimize the friction and position the thread in a well defined direction, the fact that the rollers must be separated for a while therefore requires that both be driven into motion. Moreover, the loop must be prepared in advance, which necessitates an additional mechanism. Finally, since the strand cast between the rollers is directly subject to a maximum friction resulting from the outer speed of the rollers, the thread is being worn out at that point while the acceleration which results therefrom, and which is difficult to control, develops a high thread-tensioning.

According to this invention, the process aims at eliminating these disadvantages.

In a general manner, the invention therefore relates to a process for inserting a weft thread into the space between two layers of warp threads forming the shed in a weaving loom, and the steps of this process are as follows:

storing, in a storage space, a specific or predetermined length of weft thread with one end free, stopping the accumulated thread at a point situated at a distance measured from the free end of the thread, and which must be equal at least to the pick of weft thread to be inserted, casting the thread in the shape of a loop into the space between the two layers of warp threads, said loop having one cast strand and the casting being produced by squeezing and one locked strand, the thread between two casting rollers which rotate in opposite directions and which are positioned between the locking point of the locked strand and the free end of the cast strand so that the kinetic energy of the cast strand produces a force pulling the thread from where it unwinds. According to the invention the insertion of the thread between the casting rollers takes place by lateral change of position of the said thread between a guiding point situated upstream of the common generatrix of the casting rollers and a locking point situated downstream of said common generatrix so that the weft thread, at the time of the casting operation, is moved laterally in order to insert it within the gripping line of the casting rollers so that, once cast, the thread moves along this line to form a loop between the locking point and the cast strand by driving the specific length of thread out of the storage space.

The moving of the thread into position within the gripping line of the casting rollers may be achieved either by moving the locking point, or by moving the thread to a zone situated between the guiding point and the locking point.

As a result of the lateral change of position of the thread casting, the portion of the thread which picks up speed is not cast against the portion of thread previously cast which is moving more slowly to its one side. Therefore this arrangement allows a proper formation of the loop and decreases the tensions resulting from the acceleration when starting up (surge tension) without the thread sliding between the driving surfaces. As a matter of fact, the startup speed of the thread, when not sliding, will be $V_o$ sin. $\alpha$, with $\alpha$ being the angle between the thread considered at the guiding point and the gripping line between the opposed generatrices of the rollers as shown in FIGS. 2 and 3. The startup speed being decreased, the tension will also be decreased. As the thread moves, the angle $\alpha$ will increase, therefore occasioning an increase of the thread speed. Consequently the thread speed can be accelerated without the thread sliding between the rollers.

The invention also relates to a device to implement the aforesaid process, and this device is equipped as follows:

means to store in a storage space a specific length of thread with one free end, a pair of casting rollers permitting the casting of the thread in a shape of a loop with one locked strand and one cast strand, inside the space between two layers of warp threads, this loop unwinding, when emerging from the space between two layers of warp threads, due to the effect of the kinetic energy generated at the casting time, the device being characterized as follows:

a guide is placed upstream said rollers and a gripping system is arranged so that the thread may form, between the above-mentioned elements, an angle with the gripping line between these rollers, and be maintained outside of this gripping line before being cast, there is a system permitting movement of the thread in order to insert it through the rollers between the guide and the gripping system, to cast the thread and shape it into a really tight loop, by drawing out of the storage space the specific length of thread.

If a permanent tangential contact can be achieved between the rollers, with the line between the generatrices common to both rollers constituting the gripping line, it may however be an advantage to make allowance for a very low clearance between the rollers in order to facilitate the casting operation, especially if the thread is relatively coarse, and in particular if the roller surfaces are hard. In this case, the line between the generatrices closest to each roller can constitute the gripping line. If there is a slight running clearance between the two rollers, it may be necessary to set them to rotate independently from each other.

The invention, its implementation and its possible applications may, however, be more clearly understood with the help of the following description and concrete examples which do not limit the scope of the invention, but are given as a guide hereinafter with the attached drawings.

Figure 4:
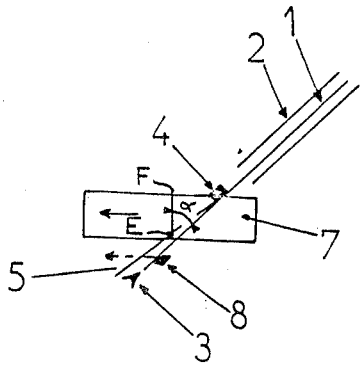
Figure 5:
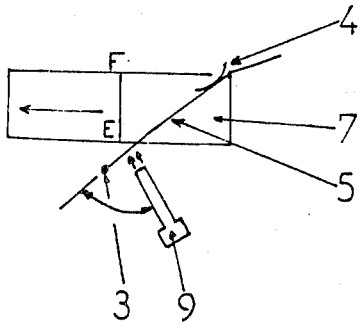
Figure 6:
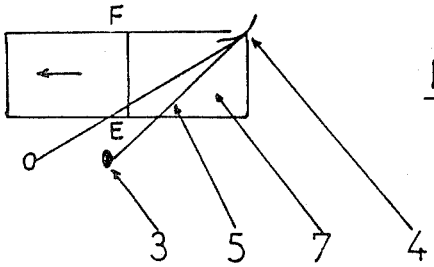

FIGS. 4, 5, and 6 are top views showing various variations allowing the thread to be moved between the rollers at the time of the casting operation.

The attached figures show that the length of thread (1) to be cast is prepared and stored in a conventional storage space (2). One end of the thread is locked, for instance by means of a clip (3) holding it at a point situated at a measured distance form the free end of the thread, and which must be equal at least to the pick of weft thread to be inserted. Moveover, a guiding element (4) constituted by a known type of lever system is placed upstream the casting rollers (6) (7), so that the section of thread (5) between the clip (3) and the lever system (4) will be sensibly inside the tangential plane common to the two rollers (6) (7), each rotating in an opposite direction. Therefore, this section of thread (5) forms with the generatrix common to the rollers (6) (7) an angle of less than 90°. To that effect, the guiding point constituted by the lever system (4) is positioned within the tangential plane common to the rollers (6) (7) upstream their common generatrix, whereas the locking point (3) is positioned within this same plane, but downstream the common generatrix, so that, before being cast, the section of thread (5) will be positioned out of the action of the casting rollers (6) (7). At the time of the casting, the section of thread (5) is moved to be positioned inside the gripping line of the rollers (6) (7) so that the thread will move along this line and a loop will be shaped out of the length of thread in storage. This insertion may be completed either by utilizing a mechanism (8) (FIG. 4) which pushes the thread into an intermediate zone between the guiding point (4) and the gripping point (3), or, as shown in FIG. 5, by utilizing a compressed air nozzle (9) in an intermediate zone, or finally (FIG. 6) by moving the gripping point (3) itself. Thus, the section of thread (5) joins point (E) on the gripping line formed between the two casting rollers (6) (7), and is carried by said rollers.

When the whole length of the cast thread, that is to say the thread contained in the storage space (2) has been pulled out of said storage space, it emerges from the casting device and keeps going through the space (S) between the two layers of warp threads forming the shed, driven by a kinetic energy varying according to its mass and its speed.

Figure 1:
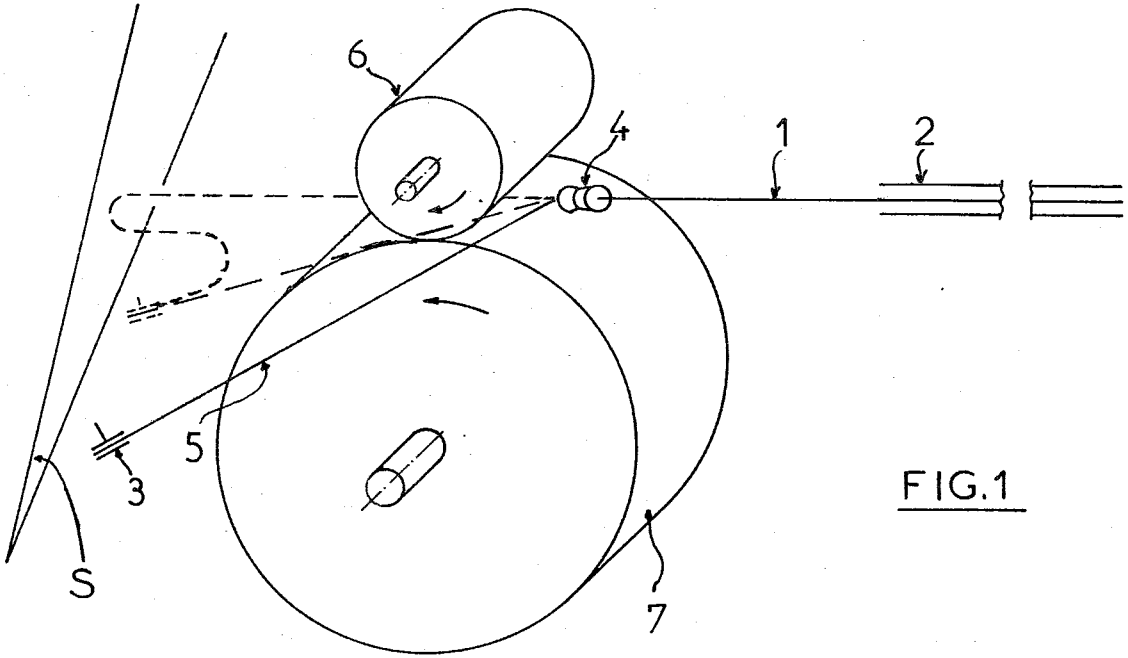
FIG. 1 is an overall diagrammatic view of a device permitting the implementation of the procedure according to the invention.
Figure 2:
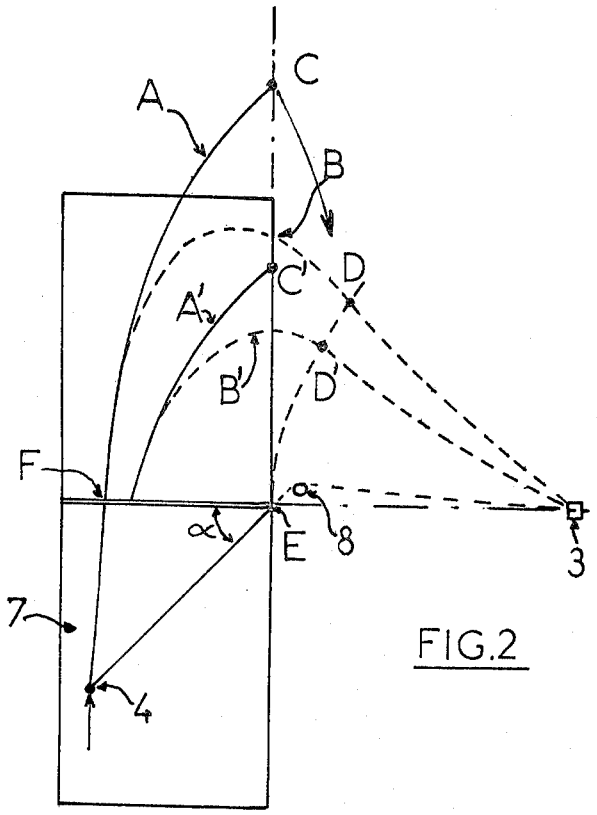
FIGS. 2 and 3 are top views showing the formation of the loop of thread according to the procedure of the invention, on one hand by utilizing cylindrical rollers (FIG. 2) for the casting, and on the other hand by utilizing truncated rollers (FIG. 3).
Figure 3:
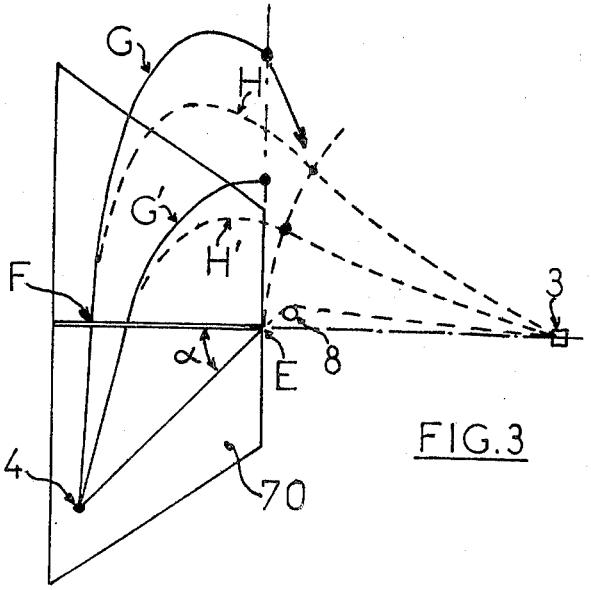

The formation of the loop is depicted in the close-up views of FIGS. 2 and 3 which respectively show the casting of the thread, on one hand by means of cylindrical rollers, and on the other hand by means of truncated rollers. As shown in these figures, under the thrust of the insertion mechanism, the point of contact of the thread with the extremity of the generatrix common to the rollers (6) (7) moves from (E) towards (F), relatively to the foot of the perpendicular drawn from the guiding point (Lever System 4) to the generatrix common to the rollers. When moving from (E) to (F), the thread (1) is gradually pulled out of the storage space (2) thus forming a loop with one strand locked in (3) while the other strand is casted by the rollers (6)–(7). During that motion, each portion of the thread cast by slanting forward would take the shape of the theoretical curve A' having a free end C' and then of the curve (A) having a free end C if the thread was free and if there was no friction. However, since the end of this thread is connected to the clip (3), said end is held at D' and then as the cast progresses at (D), and the thread is shaped into a really tight loop at B' and then as the cast progresses at (B). When the free end of the thread reaches (F), and the whole length has been pulled out of the storage space (2), it emerges from the casting device and continues its movement through the space between the two layers of warp threads of the weaving loom, driven by a kinetic energy varying according to its mass and the speed transmitted to said free end of the thread by the casting rollers (6) (7).

FIG. 3 shows a variation according to which the casting rollers are truncated. In this variation the cylindrical rollers (6) (7) are replaced by truncated rollers (60: not shown), and (70), arranged so that the circumferential speed at the point of contact of the thread, when inserted, will be lower than the circumferential speed at the point of contact (F) where the thread is after its acceleration. The speed gradually increases as the point of contact of the thread (5) with the generatrix common to the rollers (60) (70) moves from (E) to (F), allowing an acceleration which is progressive and which thus limits the tensions to which the thread is subject during the formation of the loop. FIG. 3 is similar to FIG. 2, the curves (G) (G') corresponding to the curves (A) (A') representing the theoretical curve of a free thread, whereas the curves (H) (H') corresponding to the curves (B) B') represent the loop shaped by the thread, taking into account that the thread is held at the gripping point (3).

When the casting rollers remain in permanent contact, which offers the advantage that it requires driving into motion of only one roller since the other one will be set in motion by contact with the former, it is best, in order to avoid damaging the thread by friction against a sharp angle, to round off or bevel the edge of the rollers close to point (E).

As mentioned previously, the insertion device for the portion of thread (5) may be freely designed in any imaginable type, and yet remain within the scope of the invention. This device may be mechanical in the shape of a finger (8) pushing the thread (FIG. 4), or pneumatic through the utilization of a nozzle blowing a jet of compressed air on an intermediate zone of the portion of thread (5) between the clip (3) and the lever system (4) (FIG. 5). This insertion system may even be eliminated, as shown in FIG. 6. In this case, only the clip (3) has to be moved towards the rollers (6) and (7).

Another possibility for inserting the portion of the thread (5) between the casting rollers would be to move the lever system point (4) so that the thread may progressively pass from the feeding point (E) to the casting point (F).

Of course the invention is not limited to the implemented applications described above, but it also covers all the variations of similar designs. Furthermore, if the invention described applies to the casting of a thread into a weaving loom, it may obviously be utilized for other applications, and in particular in all the cases when specific lengths of thread must be cast, for instance in the knitting machines with front insertion of the weft thread, even for the execution of non-woven cloths made of a multiplicity of threads maintained parallel to each other.

Finally, other systems for inserting the thread between the casting rollers may be considered. Thus, the insertion system could be the piston of a hydraulic or pneumatic jack, the mobile gear of an electromagnet, or a layer operated by an electric contact.

What is claimed is:

1. A process for inserting a weft thread into the space between two layers of warp thread in a weaving loom, the process comprising:

storing in a storage space a specific length of weft thread with one end free, gripping the stored weft thread at a locking point situated at a distance measured from the free end of the thread, which is at least equal to the pick of weft thread to be inserted, casting the thread in the shape of a loop into the space between the two layers of warp thread, said loop having one cast strand and one locked strand, and the casting being produced by squeezing the thread between two casting rollers which rotate in opposite directions and which are positioned between the locking point of the locked strand and the free end of the cast strand so that the kinetic energy of the cast strand produces a force which pulls the thread from where it unwinds, inserting the weft thread between the casting rollers by moving a length of weft thread between a guiding point situated upstream of the common generatrix of the casting rollers and the locking point which is situated downstream of said common generatrix laterally to the common generatrix so that the weft thread at the time of the casting operation is moved into position between the casting rollers at their common generatrix so that, once cast, the thread moves along the common generatrix to form a loop between the locking point and the cast strand by driving the length of thread out of the storage space.

2. A process for inserting a weft thread having first and second ends, in the shape of a loop, into a shed formed by two layers of warp thread comprising:

storing in a storage space the first end of the weft thread;

guiding the weft thread through a guiding point;

gripping the second end of the weft thread at a locking point;

inserting the weft thread between a pair of casting rollers rotating in opposite directions so that the rollers engage the weft thread and propel it in the form of a loop, wherein the casting rollers are positioned so that they have a common generatrix upstream of the locking point which lies between the locking point and the guiding point and the weft thread is inserted between the casting rollers by moving the length of weft thread between the guiding point and the second end laterally to one end of said common generatrix.

3. A process according to claims 1 or 2, in which the lateral movement of length of the weft thread between said guiding point and locking point in order to insert it between the casting rollers is achieved by laterally moving the locking point.

4. Device for inserting a weft thread into the shed formed by the warp threads in a weaving loom, the device comprising:

means for storing in a storage space a specific length of weft thread with one end free, a guide for directing said weft thread, a pair of casting rollers for casting the weft thread into the shed in the shape of a loop with one strand locked and one strand cast by imparting kinetic energy to the thread for the thread to unwind it from the storage space wherein said casting rollers are positioned so that they have a common generatrix downstream of the guide, a clip arranged downstream of the common generatrix so that the weft thread when laterally moved towards the common generatrix will form an angle with the common generatrix, and insertion means adapted to laterally move the length of weft thread between the clip and the guide into position at one end of the common generatrix of the casting rollers.

5. Device according to claim 4, wherein said guide means comprises a lever system for guiding the free strand.

6. Device according to claim 5, in which said insertion means is positioned between the clip and the lever system.

7. Device according to claim 6, in which the insertion means comprises a mechanical system having a finger for pushing the length of weft thread between the clip and the guide into position.

8. Device according to claim 6, in which insertion means comprises a pneumatic system adapted to blow a jet of compressed air into the length of weft thread between the clip and the guide.

9. Device according to claim 4, in which the clip is displaceable for inserting the thread between the casting rollers by displacement of the clip holding the locked strand and in which displacement of the clip may be repeated after the thread has been inserted between the casting rollers.

10. Device according to claim 5, in which the lever system is movable and adapted to laterally move the length of weft thread between the clip and the lever system.

11. Device according to claim 4, in which the casting rollers are positioned in a permanent tangential contact, and in which the circumferences of the casting rollers are bevelled on the side of the casting rollers where the length of weft thread is fed between the rollers.

* * * * *